US005140725A

United States Patent [19]

Matsushima

[11] Patent Number: 5,140,725

[45] Date of Patent: Aug. 25, 1992

[54] WOVEN SLIDE FASTENER STRINGER

[75] Inventor: Haruo Matsushima, Kurobe, Japan

[73] Assignee: Yoshida Kogyo K.K., Tokyo, Japan

[21] Appl. No.: 733,958

[22] Filed: Jul. 22, 1991

Related U.S. Application Data

[63] Continuation of Ser. No. 670,735, Mar. 18, 1991, abandoned.

[30] Foreign Application Priority Data

Mar. 19, 1990 [JP] Japan ..... 2-28040[U]

[51] Int. Cl.[5] ..... A44B 19/12

[52] U.S. Cl. ..... 24/392; 24/393; 24/403; 139/384 B

[58] Field of Search ..... 24/392, 393, 394, 391, 24/403; 139/384 B; 66/190, 192, 201, 202

[56] References Cited

U.S. PATENT DOCUMENTS

| | | | |
|---|---|---|---|
| 3,849,842 | 11/1974 | Yoshida | 24/393 |
| 3,901,291 | 8/1975 | Nogai | 139/384 B |
| 4,220,182 | 9/1980 | Glindemeyer et al. | 24/392 |
| 4,231,139 | 11/1980 | Tsubata . | |
| 4,254,803 | 3/1981 | Tsubata . | |
| 4,334,556 | 6/1982 | Frohlich et al. . | |
| 4,362,191 | 12/1982 | Frohlich et al. . | |
| 4,381,804 | 5/1983 | Griessbaum . | |
| 4,398,571 | 8/1983 | Frohlich . | |
| 4,404,998 | 9/1983 | Frolich et al. . | |
| 4,561,474 | 12/1985 | Ofusa . | |
| 4,597,418 | 7/1986 | Ofusa | 24/392 |
| 4,623,004 | 11/1986 | Matsushima et al. . | |
| 4,678,013 | 7/1987 | Ofusa et al. . | |
| 4,799,515 | 1/1989 | Ohfusa . | |
| 4,915,140 | 4/1990 | Ofusa et al. . | |
| 4,924,560 | 5/1990 | Matsuda et al. | 139/384 B |

FOREIGN PATENT DOCUMENTS

| | | |
|---|---|---|
| 3347067 | 4/1985 | Fed. Rep. of Germany . |
| 1-37441 | 11/1989 | Japan . |

*Primary Examiner*—Victor N. Sakran

*Attorney, Agent, or Firm*—Hill, Van Santen, Steadman & Simpson

[57] ABSTRACT

A woven slide fastener stringer has a web section and a woven filament section defining a longitudinal edge portion and including successive loops formed from a woven plastic filament and each having upper and lower legs and is provided with a plurality of tensioning warp threads and a plurality of loop fastening warp threads both interposed between binding warp threads and adapted to draw the upper and lower legs closely together and hold the loops stably in place on the stringer.

4 Claims, 3 Drawing Sheets

WOVEN SLIDE FASTENER STRINGER

This is a continuation of Ser. No. 670,735, filed Mar. 18, 1991, now abandoned.

BACKGROUND OF THE INVENTION

1. Field of the Invention

This invention relates generally to a slide fastener and has particular reference to a fastener stringer having a continuous plastic filament spirally formed and woven simultaneously into a longitudinal edge of a stringer tape.

2. Prior Art

There have been proposed a number of slide fasteners or zippers of the type described, which comprise a woven stringer tape and a plastic filament woven into a longitudinal edge of the tape, the filament being usually formed into a helical coil structure composed of a succession of loops or elongated convolutions each having a coupling head, an upper and a lower leg and a connecting portion.

When bent into such helical coil formation, the filament which is thicker and harder than the weave yarn tends to yield back, thereby causing the fastener stringer to stretch longitudinally and the filament loops to tilt away from an upright posture with respect to the plane of the stringer tape. This displacement of the filament loops would result in irregular pitch of the filament loops, which in turn hinders smooth closing and opening operation of the slide fastener.

A woven slide fastener stringer is exemplified in DE 3347067 which is aimed at eliminating or alleviating the above noted drawbacks of the conventional stringers and which comprises a weave system for affixing a row of coupling elements to and along a longitudinal edge of each of two companion support tapes, the weave system essentially comprising supplemental warp yarns running in a manner similar to lower binding warp yarns and extending substantially linearly under the lower surface of a lower leg portion of each coupling element and tightening warp yarns extending, similarly to upper binding warp yarns, alternately over and under two adjacent coupling elements. The tightening warp yarns are intended to bring the upper and lower leg portions of the coupling elements closely together and at the same time to urge laid-in weft yarns intimately against the lower leg portions of the elements. This prior woven stringer device however has the difficulty that when enough tension is applied to the tightening warp yarns to held the coupling elements firmly in place, this would cause disturbance or malalignment of adjacent elements or irregularities in the element-to-element interspace or pitch and therefore, a compromise is required in the amount of tension to the weave system such that the coupling elements tend to shift out of the proper operative posture.

Another prior woven stringer is introduced in Japanese Utility Model Publication No. 1-37441 in which a plurality of binding warp yarns are provided in parallel with each other both over the upper legs and under the lower legs of a row of coupling elements, and gap-filling or tightening yarns are interwoven with weft yarns extending over the upper legs and under the lower legs of the elements. A drawback of this prior device is that the weft yarns interposed between the upper legs of adjacent elements are apt to interfere with the tightening warp yarns, resulting in a reduction in the tension required to pull the element legs together and also to adhere the weft yarns to the lower legs of the elements.

SUMMARY OF THE INVENTION

With the foregoing drawbacks of the prior art in view, the present invention seeks to provide a woven slide fastener stringer of a relatively low profile which has a row of coupling elements woven helically into a longitudinal edge of a woven support tape and which incorporates a novel weave structure such that the row of elements is secured in the proper position and posture over the entire length of the stringer against displacement relative to the tape or against element-to-element pitch disruption which would result in defective or inoperative slide fastener.

According to the invention, there is provided a woven slide fastener stringer comprising: a woven stringer tape having a web section and a filament woven section defining a longitudinal edge portion of the stringer tape and formed with foundation warp threads and a weft thread; a row of successively interconnected elongated loops formed from a plastic filament and woven into the filament woven section, each of the loops having a coupling head at one end thereof, and an upper leg and a lower leg extending from the head in a common direction, and a heel portion remote from the head connected to a next adjacent one of the successive loops; a group of upper binding warp threads extending in parallel longitudinally of the stringer tape and overlying the upper legs of the filament loops and a group of lower binding warp threads extending in parallel longitudinally of the stringer tape, and underlying the lower legs of the filament loops, the groups of binding warp threads running as a whole substantially along a straight path at the edge portion of the tape; a plurality of tensioning warp threads extending parallel with and between the upper and lower binding warp threads and passing alternately over the weft thread between each adjacent loops and under the weft thread disposed in contact with a lower surface of each of the lower legs of the loops; and a plurality of fastening warp threads extending parallel with and between the upper and lower warp threads and each overlying an upper surface of each of the upper legs and underlying the weft thread disposed in contact with the lower surfaces of the lower legs of the loops.

Other advantages and features of the present invention will be better understood from reading the following detailed description with reference to the accompanying drawings which illustrate by way of example a preferred embodiment.

DETAILED DESCRIPTION OF THE PREFERRED EMBODIMENT

Figure 1:
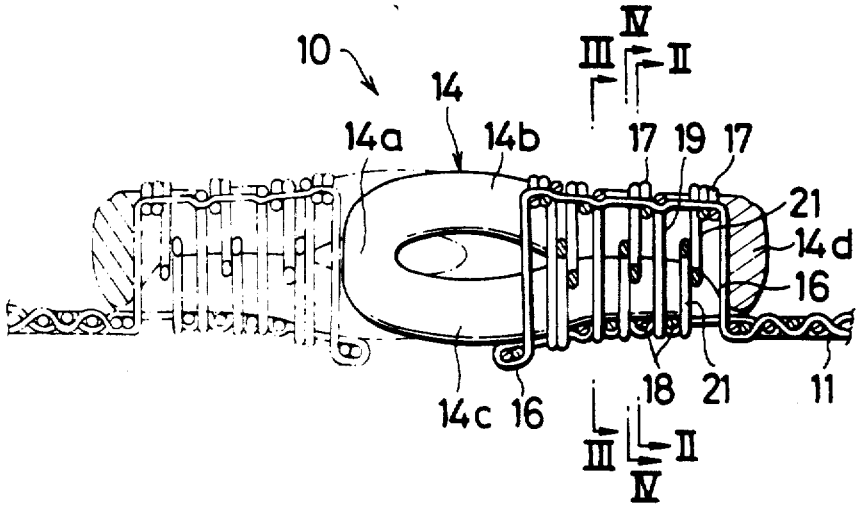
FIG. 1 is a transverse cross-sectional view on enlarged scale of a woven slide fastener stringer embodying the invention.

A fastener stringer generally designated 10 constitutes one part of a pair of identical stringers for a slide fastener. The stringer 10 includes a woven stringer tape 11 having a generally flat web section 11*a* (only partly shown) defining a major dimension of the stringer tape 11 and a filament woven section 11*b* defining a longitudinal edge portion 12 of the stringer tape 11 into which a filament 13 of plastic material such as polyester, polyamide and the like is laid in double pick and woven in the form of a row of successively interconnected elongated loops each of which serves as a fastener coupling element.

Each loop or elongated convolution 14 of the filament 13 has a coupling head 14*a* at one end thereof, an upper leg 14*b* and a lower leg 14*c* extending from the head 14*a* in a common direction and a heel portion 14*d* remote from the head 14*a* connected to a next adjacent one of the successive loops 14. The coupling head 14*a* is dimensioned to releasably couple with a corresponding head of a loop 14 on a mating stringer to open and close the fastener in a well known manner.

The web section 11*a* of the stringer tape 11 may be of any known design having foundation warp threads 15 and a foundation weft thread 16 interwoven therewith in a variety of patterns, which will require no further explanation as this has no direct bearing upon the invention.

Figure 5:
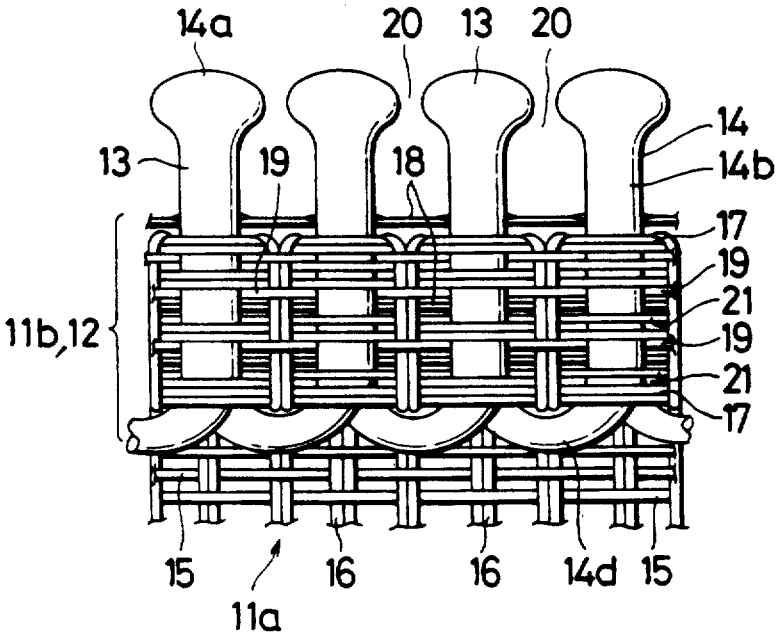
FIG. 5 is a plan view on enlarged scale of a front portion of the stringer of FIG. 1.
Figure 6:
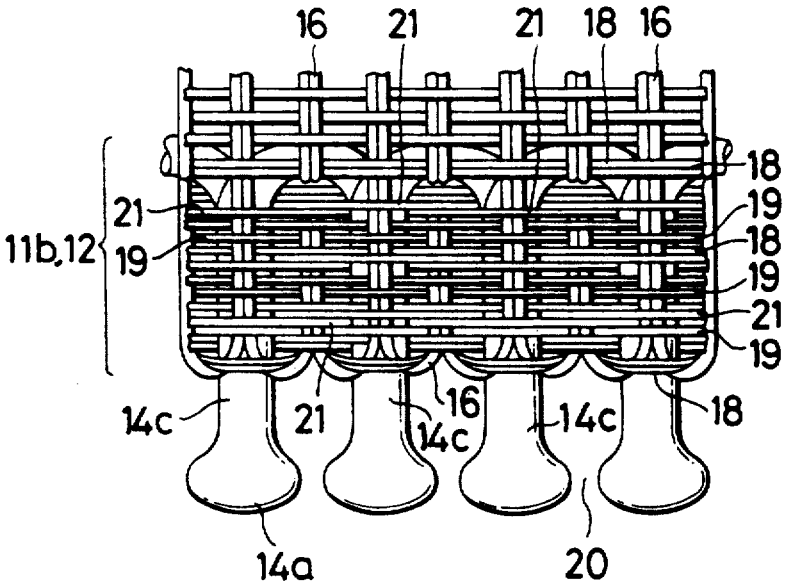
FIG. 6 is a plan view of a reverse portion of the same.

In the filament woven section 11*b* of the stringer tape 11, there are provided a group of upper binding warp threads 17 extending in parallel longitudinally of the stringer tape 11 and overlying the upper legs 14*b* of successive filament loops 14 as better shown in FIG. 5, and a group of lower binding warp threads 18 extending in parallel longitudinally of the stringer tape 11 and underlying the lower legs 14*c* of successive loops 14 as better shown in FIG. 6, both groups of binding warp threads 17, 18 running as a whole substantially along a straight path at the region of the legs 14*b*, 14*c*.

In the illustrated embodiment, the number of the lower binding warp threads 18 is shown greater than that of the upper binding warp threads 17 but may be the same for the purpose of the invention, and the respective threads 17 and 18 are shown woven in double along both the outermost position closest to the loop beads 14*a* and the innermost position closest to the loop heel 14*d* but may be woven singly and may also be thicker than the remaining binding warp threads.

Figure 2:
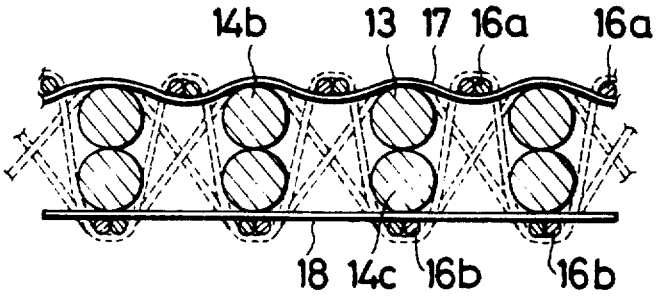
FIG. 2 is a cross-sectional view taken on the lines II—II of FIG. 1.
Figure 3:
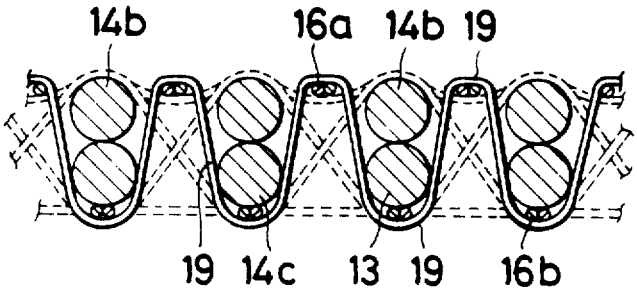
FIG. 3 is a cross-sectional view taken on the lines III—III of FIG. 1.
Figure 4:
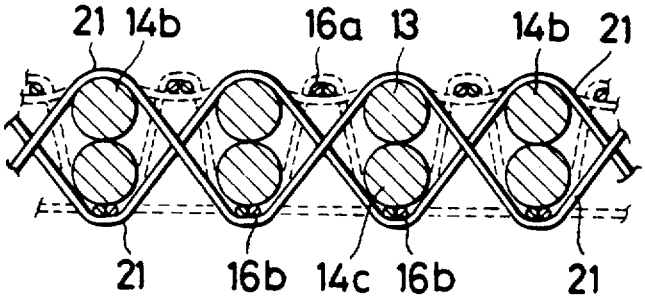
FIG. 4 is a cross-sectional view taken on the lines IV—IV of FIG. 1.

The foundation weft thread 16 is laid in from the web section 11*a* into the filament woven section 11*b* so as to overlie the upper binding warp threads 17 intermediate between the upper legs 14*b* of adjacent filament loops 14 as at 16*a* and underlie the lower binding warp threads 18 immediately underneath the lower surface of the lower legs 14*c* of each of the successive loops 14 as at 16*b* as shown in FIGS. 2–4.

A plurality of tensioning warp threads 19 extends parallel with and between the upper and lower binding warp threads 17, 18 and passes alternately over the weft thread 16 disposed in the inter-loop spaces 20 between each adjacent loops 14 and under the weft thread 16 disposed under and held in contact with the lower surface of each of the lower legs 14*c* of the successive loops 14 as better shown in FIG. 3, the arrangement being that the tensioning threads 19 urge the overlying portion 16*a* of the weft thread 16 to draw the upper and lower legs 14*b* and 14*c* closely together and the underlying portion 16*b* of the weft thread 16 to abut firmly against the lower surfaces of the lower legs 14*c* of the loops 14.

A plurality of loop fastening warp threads 21 extend parallel with and between the upper and lower binding warp threads 17, 18 and each alternately overlies the upper surface of each of the upper legs 14*b* of the loops 14 and underlies the weft thread 16 held in abutting engagement with the lower surface of each of the lower legs 14*c* of the loops 14, thus extending symmetrically in intercrossed relation to one another longitudinally of the woven filament section 11*b* of the stringer tape 11 as cross-sectionally observed as shown in FIG. 4. Since the fastening warp threads 21 extend in direct contact with the upper legs 14*b* of the loops 14, they can bring the upper and lower legs 14*b*, 14*c* closely together without interference by the weft thread 16 and thus hold the loops 14 of the coupling filament 13 firmly in place with respect to the woven filament section 11*b* of the tape 11. The fastening warp threads 21, being in pressure engagement with the weft thread 16 at the underlying portion 16*b* thereof, further contribute to firm fixation of the weft thread 16 onto the lower surfaces of the lower loop legs 14*c*.

The tensioning warp threads 19 and the fastening warp threads 21 may be, for the purpose of the invention, disposed in the same or different longitudinal spaces between adjacent parallel upper and lower binding warp threads 17 and 18. The tensioning warp threads 19 and the fastening warp threads 21 both incorporated in the filament section 11*b* of the tape 11 cooperate in providing a synergistic effect on stable positioning of the coupling filament 13 with accurate inter-loop pitch with respect to the stringer tape 11 for a relatively thin or low profile woven slide fastener.

Obviously, various modifications and variations of the present invention are possible in the light of the above teaching. It is therefore to be understood that within the scope of the appended claims the invention may be practiced otherwise than as specifically described.

What is claimed is:

1. A woven slide fastener stringer comprising: a woven stringer tape having a web section and a filament woven section defining a longitudinal edge portion of said stringer tape and formed with foundation warp threads and a weft thread; a row of successively interconnected elongated loops formed from a plastic filament and woven into said filament woven section, each of said loops having a coupling head at one end thereof, and an upper leg and a lower leg extending from said head in a common direction, and a heel portion remote from said head connected to a next adjacent one of said successive loops; a group of upper binding warp threads extending in parallel longitudinally of said stringer tape and overlying said upper legs of said filament loops and a group of lower binding warp threads extending in parallel longitudinally of said stringer tape, and underlying said lower legs of said filament loops, said groups of binding warp threads running as a whole substantially along a straight path at said edge portion of said tape; a plurality of tensioning warp threads extending parallel with and between said upper and lower binding warp threads and passing alternately over said weft thread between each adjacent loops and under said weft thread disposed in contact with a lower surface of each of said lower legs of said loops; and a plurality of fastening warp threads extending parallel with and between said upper and lower warp threads and each overlying an upper surface of each of said upper legs and underlying said weft thread disposed in contact with the lower surfaces of said lower legs of said loops.

2. A woven slide fastener stringer according to claim 1 wherein said fastening warp threads extend cross-sectionally symmetrically in intercrossed relation to one another.

3. A woven slide fastener stringer according to claim 1 wherein said tensioning threads and said fastening threads are disposed in longitudinal spaces between adjacent parallel upper and lower binding warp threads.

4. A woven slide fastener stringer according to claim 1 wherein a plurality of said upper and lower binding warp threads are disposed closest to said heads and said heel portions respectively of said loops.

* * * * *